US005095644A

United States Patent [19]

McCoy

[11] Patent Number: 5,095,644

[45] Date of Patent: Mar. 17, 1992

[54] BLACK POWDER FIREARM CLEANING KIT

[76] Inventor: Keith E. McCoy, Rte. 2, Box 450, Stanley, Va. 22851

[21] Appl. No.: 594,433

[22] Filed: Oct. 5, 1990

[51] Int. Cl.[5] ..... F41A 29/00

[52] U.S. Cl. ..... 42/95

[58] Field of Search ..... 42/95; 15/104.16

[56] References Cited

U.S. PATENT DOCUMENTS

| | | | |
|---|---|---|---|
| 1,522,837 | 1/1925 | Rebar | 42/95 |
| 4,045,900 | 9/1977 | Byer | 42/95 |
| 4,404,979 | 9/1983 | Hobbs | 42/95 |
| 4,858,360 | 8/1989 | Hardin | 42/95 |

*Primary Examiner*—Charles T. Jordan

*Attorney, Agent, or Firm*—Leon Gilden

[57] ABSTRACT

An organization including a pump member defined by an elongate cylindrical body mounting a flexible cylindrical body at a forward end thereof, with a piston coaxially and slidably mounted within the rigid cylindrical body operative through a manually manipulated coaxial rod, with the cleaning brush mounted coaxially to the piston through the flexible cylindrical body to effect plunging and cleaning of a black powder firearm bore. A first conduit pipe directs water within the rigid cylindrical body forwardly of the piston to direct cleaning water through the firearm bore and further provides a nipple adapter to direct the fluid exteriorly of the firearm during a cleaning procedure.

6 Claims, 4 Drawing Sheets

PRIOR ART

BLACK POWDER FIREARM CLEANING KIT

BACKGROUND OF THE INVENTION

1. Field of the Invention

The field of invention relates to flintlock firearms, and more particularly to a new and improved black powder firearm cleaning kit wherein the same permits effective cleaning of a longitudinal bore of an associated black powder firearm.

2. Description of the Prior Art

Both flintlock and percussion type firearm rifles utilized in black powder shooting are firearms that date to the seventeenth century. An ignition primer acts through a longitudinal bore in the barrel noted as a "touch hole" to ignite initial charge and black powder contained within the firearm. In cleaning of the firearm, flushing of the bore with warm water and soap is utilized in a time-consuming and frequently untidy procedure. The instant invention attempts to overcome deficiencies of the prior art that have addressed the issue of black powder firearm cleaning by providing an organization whose assemblage permits a convenient and efficient cleaning of the aforenoted firearm. Prior art examples include U.S. Pat. No. 4,404,979 to Hobbs setting forth a drain hose in cooperation with a firearm to effect draining of fluid directed from the barrel of the associated firearm.

U.S. Pat. No. 1,522,837 to Rebar sets forth a cleaning device defined by an elongate rod, including a through-extending bore, with a cup member at the upper end of the bore to direct fluid into an associated muzzle of a rifle, with a brush member selectively securable to a lower end of the bore for cleaning of a rifle barrel.

U.S. Pat. No. 4,858,360 to Hardin sets forth a ramrod structure for use in cleaning of a rifle barrel utilizing a through-extending bore, with a pressure bulb to direct fluid through the rod into the bore of an associated rifle.

As such, it may appreciated that there continues to be a need for a new and improved black powder firearm cleaning kit as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of black powder cleaning organizations now present in the prior art, the present invention provides a black powder firearm cleaning kit wherein the same permits directing of pressurized cleaning fluid through an elongate longitudinal bore of an associated firearm. As such, the general purpose of the present invention, which will be described subsequently in greater detail, is to provide a new and improved black powder firearm cleaning kit which has all the advantages of the prior art firearm cleaning kit organizations and none of the disadvantages.

To attain this, the present invention provides an organization including a pump member defined by an elongate cylindrical body mounting a flexible cylindrical body at a forward end thereof, with a piston coaxially and slidably mounted within the rigid cylindrical body operative through a manually maniuplated coaxial rod, with the cleaning brush mounted coaxially to the piston through the flexible cylindrical body to effect plunging and cleaning of a black powder firearm bore. A first conduit pipe directs water within the rigid cylindrical body forwardly of the piston to direct cleaning water through the firearm bore and further provides a nipple adapter to direct the fluid exteriorly of the firearm during a cleaning procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved black powder firearm cleaning kit which has all the advantages of the prior art firearm cleaning kit organizations and none of the disadvantages.

It is another object of the present invention to provide a new and improved black powder firearm cleaning kit which may be easily and efficiently manufactured and marketed.

It is a further object of the present invention to provide a new and improved black powder firearm cleaning kit which is of a durable and reliable construction.

An even further object of the present invention is to provide a new and improved black powder firearm cleaning kit which is susceptible of a low cost of manufacture with regard to both materials and labor, and which accordingly is then susceptible of low prices of sale to the consuming public, thereby making such black powder firearm cleaning kits economically available to the buying public.

Still yet another object of the present invention is to provide a new and improved black powder firearm cleaning kit which provides in the apparatuses and methods of the prior art some of the advantages thereof, while simultaneously overcoming some of the disadvantages normally associated therewith.

Still another object of the present invention is to provide a new and improved black powder firearm cleaning kit wherein the same permits directing of a cleaning fluid through a longitudinal bore of an associated firearm for effective and convenient cleaning thereof.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
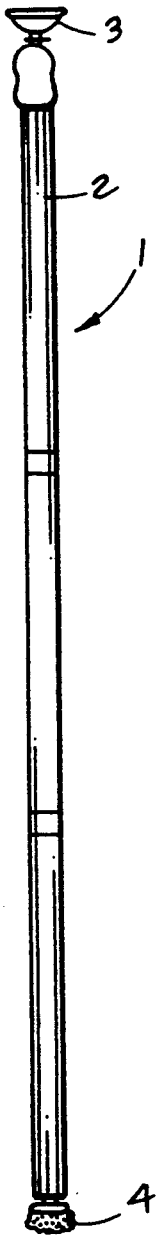
FIG. 1 is an orthographic view, taken in elevation, of a prior art black powder type firearm cleaning organization.

With reference now to the drawings, and in particular to FIGS. 1 to 7 thereof, a new and improved black powder firearm cleaning kit embodying the principles and concepts of the present invention and generally designated by the reference numeral 10 will be described.

Figure 2:
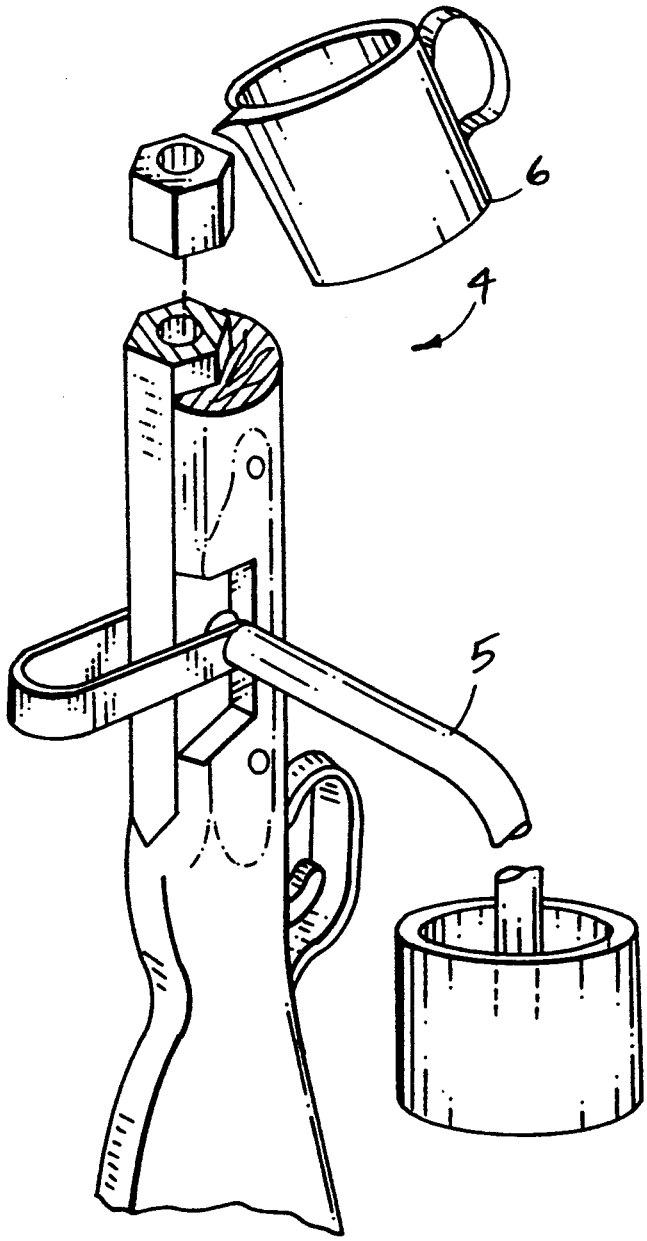
Fig 2 PRIOR ART
FIG. 2 is an isometric illustration of a further prior art example of a black powder firearm cleaning organization.
Figure 3:
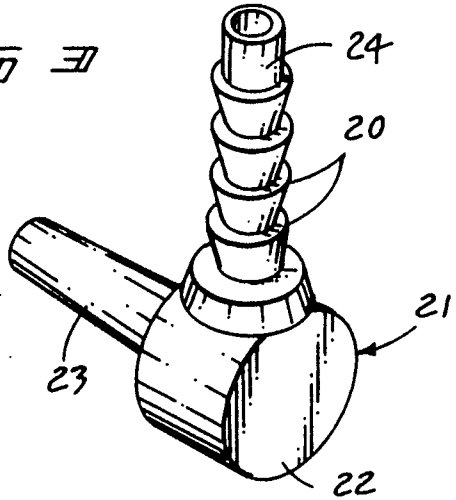
FIG. 3 is an isometric illustration of the nipple adapter utilized by the cleaning kit of the instant invention.
Figure 4:
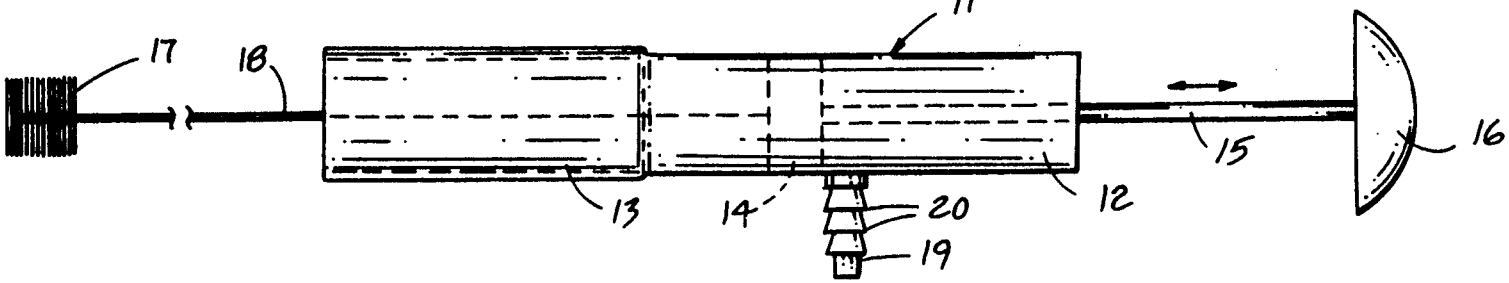
FIG. 4 is an orthographic side view, taken in elevation, of the cleaning pump utilized by the instant invention.

FIG. 1 illustrates a prior art cleaning organization 1, wherein an elongate rod 2 includes a through-extending bore therethrough, with a cup member 3 mounted at an upper end thereof to direct fluid through the bore, with a brush type member 4 selectively mounted to the lower end of the rod for cleaning purposes, in a manner as set forth in U.S. Pat. No. 1,522,837. FIG. 2 illustrates a further prior art cleaning organization 4, wherein an exit hose 5 directs fluid from the touch hole of the firearm that is directed into the firearm from a fluid container 6.

Figure 5:
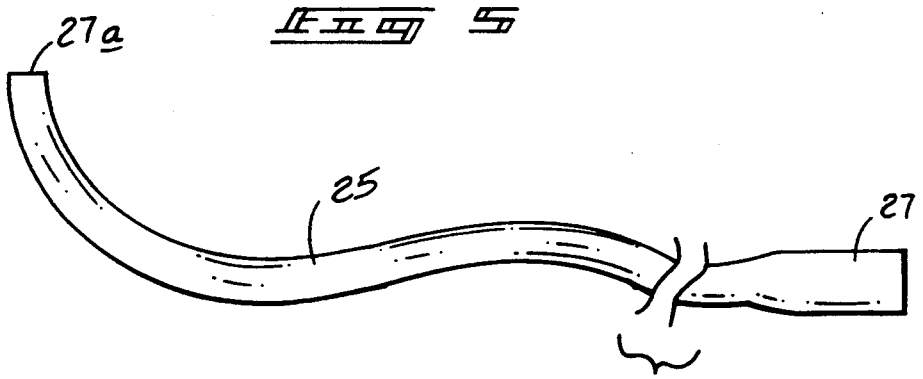
FIG. 5 is an orthographic view of a first cleaning hose utilized by the instant invention.
Figure 6:
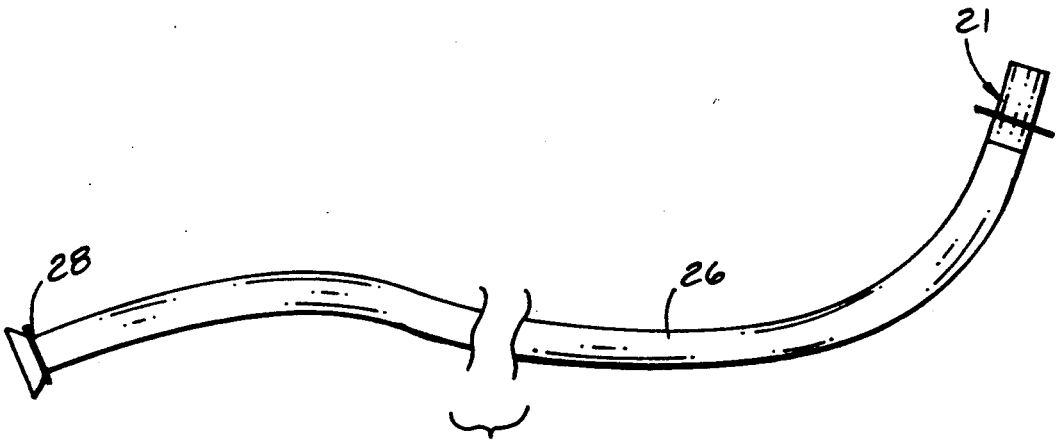
FIG. 6 is an orthographic view of a second cleaning hose utilized by the instant invention.
Figure 7:
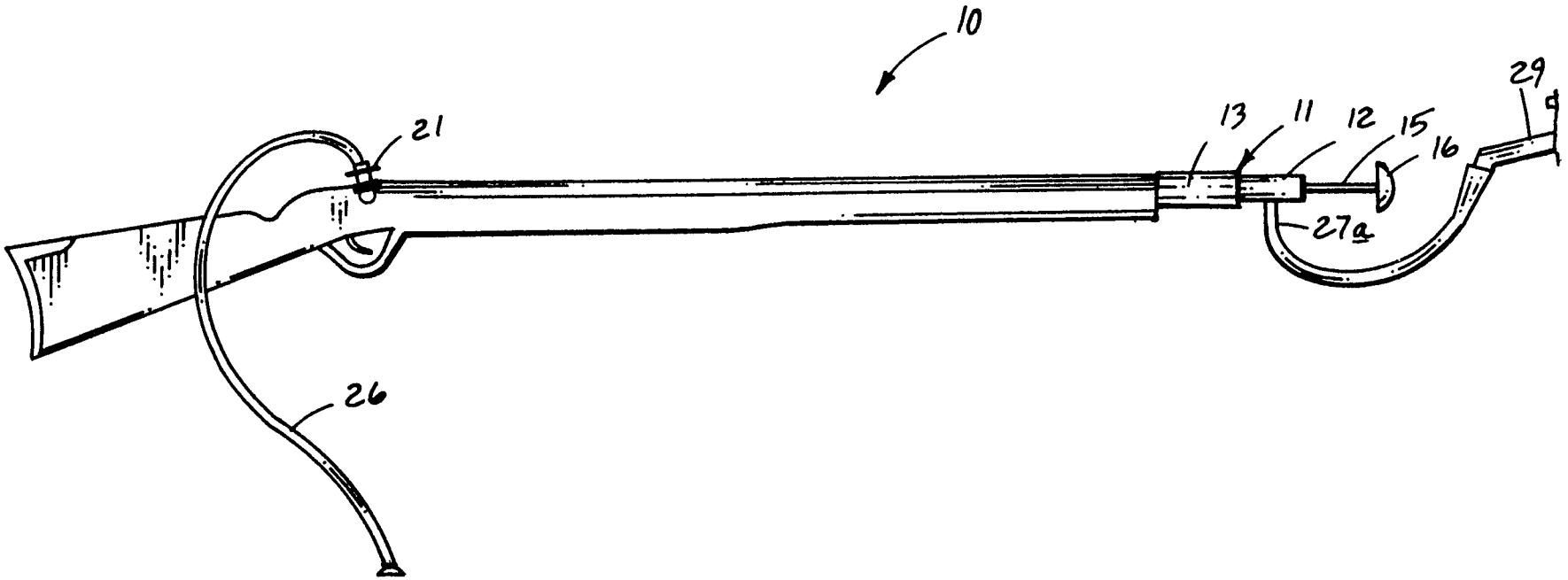
FIG. 7 is an orthographic side view, taken in elevation, of the organization in operative association with a black powder type firearm.

More specifically, the black powder firearm cleaning kit 10 of the invention includes a cleaning pump 11, with an elongate axially aligned rigid cylindrical body 12, with a flexible cylindrical body 13 coaxially mounted to a forward end of the rigid cylindrical body 12 coaxially aligned with the cylindrical body 12 for flexible and surrounding engagement with a forward end of a firearm muzzle, as illustrated in FIG. 7. A piston 14 is slidably and sealingly mounted within the cylindrical body 12, with a piston rod 15 extending outwardly of the cylindrical body 12 rearwardly thereof terminating in a plunger head 16 arranged for manual grasping to permit reciprocation of the piston 14 within the cylindrical body 12. A cleaning brush 17 is mounted at a forward terminal end of a cleaning brush rod 18 that is fixedly and coaxially mounted to a forward end of the piston 14 coaxially aligned with the piston and the piston rod 15. A conduit pipe 19 is directed into the cylindrical body 12 to direct a water or water solution into the cylindrical body 12 forwardly of the piston, when the piston is in a rearwardly oriented first position, and to permit directing of fluid by the piston 14 within the bore to effect cleaning and brushing of the bore during use. The conduit pipe 19 includes a plurality of spaced coaxially arranged annular ridges 20 to enhance securement of a first flexible hose 25, as illustrated in FIG. 5. The first flexible hose 25 includes a first hose expanded forward end for securement overlying a pressurized water source 29, such as a faucet, as illustrated in FIG. 7, with the first hose rear end **27*a* securable about the conduit pipe 19. A nipple adapter 21 is provided, including a central housing 22, with a flexible sheath 23 in fluid communication with the housing 22 that is sealingly securable about a nipple of the associated firearm, as illustrated in FIG. 7. A second conduit pipe 24 is mounted to the central housing 22 in fluid communication to the central housing with the flexible sheath 23. A second flexible hose 26 is mounted at its forward end to the second conduit pipe 24 to permit directing of fluid through the rifle barrel, through the nipple, subsequently through the nipple adapter, and through the second hose to a drain connection 28** that is positioned in association with a convenient drain for the fluid.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A black powder firearm cleaning kit for securement to a black powder firearm, wherein the firearm includes a longitudinally aligned barrel, and a nipple in communication with the barrel mounted rearwardly thereof, wherein the cleaning kit comprises, longitudinally aligned pump means, wherein the pump means includes a flexible member for securement to a forward end of the barrel for directing cleaning fluid through the barrel, and a nipple adapter member securable to the nipple for directing the fluid exteriorly of the nipple.

2. A cleaning kit as set forth in claim 1 wherein the pump means includes an elongate coaxially aligned rigid cylindrical body, and a flexible member includes a flexible cylindrical body coaxially and fixedly mounted in alignment to a forward end of the rigid cylindrical body, and a piston reciprocatably mounted within a rigid cylindrical body, and a piston rod coaxially aligned with the rigid cylindrical body fixedly mounted to the piston and directed exteriorly through the rear end of the rigid cylindrical body, and a plunger head mounted to the piston rod at a rear end thereof remote from the piston.

3. A cleaning kit as set forth in claim 2 wherein the piston further includes a brush rod coaxially and fixedly mounted to the piston directed through the flexible cylindrical body, and a cleaning brush mounted to the brush rod at a forward end of the brush rod remote from the piston.

4. A cleaning kit as set forth in claim 3 wherein a first conduit pipe is mounted to the cylindrical body in fluid communication with the cylindrical body.

5. A cleaning kit as set forth in claim 4 including a first flexible hose, wherein the hose includes a rear terminal end securable to the first conduit pipe, and a forward terminal end securable to a pressurized water source, wherein the forward terminal end is defined by an expanded end portion relative to the first flexible hose.

6. A cleaning kit as set forth in claim 5 wherein the nipple adapter member includes a central housing, the central housing including a flexible sheath in fluid communication with the central housing, the flexible sheath securable about the nipple in a fluid sealing relationship thereto, and the central housing further including a second conduit pipe, and a second flexible hose securable to the second conduit pipe with the second flexible hose including a rear end for positioning in fluid communication with a drain member.

* * * * *